United States Patent [19]

Yang

[11] Patent Number: 4,687,190

[45] Date of Patent: Aug. 18, 1987

[54] BENCH VISE

[76] Inventor: Tai-Her Yang, 5-1 Taipin St., Si-HuTown, Dzan-Hwa, Taiwan

[21] Appl. No.: 867,495

[22] Filed: May 28, 1986

[51] Int. Cl.[4] ..... B25B 1/04

[52] U.S. Cl. ..... 269/239; 269/246

[58] Field of Search ..... 269/246, 239

[56] References Cited

U.S. PATENT DOCUMENTS

| | | | |
|---|---|---|---|
| 115,275 | 5/1871 | Brown | 269/239 |
| 184,503 | 11/1876 | Canedy | 269/239 |
| 196,854 | 11/1877 | Anderson | 269/239 |
| 225,563 | 3/1880 | Canedy | 269/239 |
| 514,614 | 2/1894 | Brintnall | 269/239 |
| 708,038 | 9/1902 | Harper | 269/239 |
| 1,129,752 | 2/1915 | Stewart | 269/239 |

*Primary Examiner*—Robert C. Watson

*Attorney, Agent, or Firm*—Leonard Bloom

[57] ABSTRACT

A bench vise of the type having a fixed jaw and a movable jaw is provided wherein the movable jaw is a pivotable, adjustable jaw capable of utilizing a variety of angles of attack, thereby securely holding irregular as well as regular shaped workpieces. The bench vise is further formed having a flat fixed jaw and a forward anvil portion in order to provide a surface adequate to permit work to be performed thereon.

13 Claims, 8 Drawing Figures

BENCH VISE

FIELD OF THE INVENTION

The present invention involves a bench vise and, in particular, a bench vise adapted to be utilized on any portion of the surface of a bench, the vise being formed with a forward anvil portion, a fixed flat jaw and a pivotable, adjustable jaw capable of securely holding irregular as well as regular shaped workpieces.

BACKGROUND OF THE INVENTION

Traditional bench vises, of which I am aware, provide a clamping jaw which have only one angle of attack in order to effect clamping. That is, the clamping jaw is limited so it may only be moved laterally in the direction of the main body. Such a structure is disadvantageous where: (1) the workpiece being clamped is of an irregular shape; and (2) where one desires to bend the workpiece along the edge of the device while it is clamped.

Traditional bench vises, of which I am aware, also do not provide for an adequate working surface which can be utilized for working on the workpiece during the clamping thereof. Finally, traditional vises of which I am aware are not readily adaptable for use anywhere on the surface of a bench, but rather, are adapted to be used only at an edge thereof.

Thus, it will be appreciated that there remains a need for a bench vise having a clamping jaw capable of clamping a workpiece utilizing a variety of angles of attack. There is also a need to provide a bench vise which provides a surface adequate to permit work to be performed thereon. There is also a need for a bench vise which combines all of these features, that is more compact, that provides better "purchase power" and stability and which is adaptable for use on any portion of the surface of a bench.

SUMMARY OF THE INVENTION

Accordingly, it is the primary objective of the present invention to alleviate the disadvantages and deficiencies of the prior art by providing a bench vise for clamping a workpiece, having a moveable jaw capable of a variety of angles of attack for clamping a workpiece therein.

It is another object of the present invention to provide a bench vise having a suitable working surface which can be utilized to permit work to be performed on a workpiece being clamped therein.

In accordance with the teachings of the present invention, a bench vise for clamping a workpiece, said bench vise being supported on the top surface of a bench, said bench vise being of the type having a fixed jaw and a movable jaw is provided. The improvement on this bench vise comprising said movable jaw being arcuately movable in a direction towards the fixed jaw for clamping the workpiece therebetween.

In further accordance with the teachings of the present invention, a bench vise for clamping a workpiece is provided. Said bench vise is comprised of a main body portion having a forward portion and a rearward portion. An anvil is integrally formed on the forward portion of the main body. A flat, fixed jaw is positioned rearwardly of the anvil. Said main body portion is provided having a longitudinally extending threaded aperture formed in the rearward portion. An arcuately movable jaw is secured to the main body about a pivot point for pivotal movement thereabout. Said movable jaw has an elongated slot formed therein. Means is provided for securing the movable jaw to the main body about the pivot point for pivotal movement of the movable jaw. A crank rod is provided having a forward threaded end and a rearward crank handle. Said rod is disposed through the elongated slot and the threaded aperture respectively. Positioned thusly, the forward threaded end of the crank rod threadily engages the threaded aperture, such that rotational movement of the rearward crank handle results in concommittant rotation of that portion of the rod carrying the movable jaw thereon pivoting said jaw towards the fixed jaw, clamping a workpiece therebetween. Also positioned thusly, counter rotational movement of the rearward crank handle results in counter concommittant rotation of that portion of the rod carrying the movable jaw thereon, pivoting said jaw away from the fixed jaw, releasing a workpiece clamped therebetween.

In yet further accordance with the teachings of the present invention, a bench vise for clamping a workpiece is provided. Said bench vise is comprised of a main body portion having a forward portion and a rearward portion. The main body portion further has a tapped recess formed in the rearward portion thereof. A movable jaw is provided having an elongated slot formed therein. A pivot pin is carried by the movable jaw. Said pivot pin is disposed in the main body below the tapped recess on an axis transverse to the direction of movement of the movable jaw, whereby pivotal movement of the jaw is provided. A rod having a forward threaded end and a rearward end is provided being received through the elongated slot, the forward end threadably engaging the tapped recess. A handle means is carried on the rearward end of the crank rod, wherein rotational movement of the handle means pivots the movable jaw in a direction towards the fixed jaw, thereby clamping a workpiece therebetween. Furthermore, counter rotational movement of the handle means pivots the movable jaw in a direction away from the fixed jaw, thereby releasing a workpiece clamped therebetween.

In still yet further accordance with the teachings of the present invention, a bench vise for clamping a workpiece is provided. Said bench vise comprised of a main body portion having a forward portion, and a rearward portion. The main body has a flanged base. An anvil is integrally formed on the forward portion of the main body. A flat, fixed jaw is positioned rearwardly of the anvil. Said main body portion further has a longitudinally extending threaded aperture formed in the rearward portion. A movable jaw is provided having an aperture formed therein. A pair of guide rods are positioned parallel to one another on a common horizontal plane. Said guide rods are piloted in, and extend rearwardly from, the rearward portion of the main body. Said guide rods are further received in the movable jaw, wherein said movable jaw is slidably carried thereon. A crank rod is provided having a forward threaded end and a rearward crank handle. Said rod is disposed through the aperture on the movable jaw and the threaded aperture respectively. Positioned thusly, the forward threaded end of the crank rod threadably engages the threaded aperture, such that rotational movement of the rearward crank handle results in concommittant rotation of that portion of the rod carrying the movable jaw thereon, moving said jaw in a direction towards the fixed jaw clamping a workpiece therebetween. Furthermore, positioned thusly, counter rotational movement of the rearward crank handle results in counter concommittant rotation of that portion of the rod carrying the movable jaw thereon, carrying said jaw in a direction away from the fixed jaw, releasing a workpiece clamped therebetween.

These and other objects of the present invention will become apparent from a reading of the following specification taken in conjunction with the enclosed drawings.

BRIEF DESCRIPTION OF THE DRAWINGS

FIG. 1-1 is a top plan view of the bench vise of FIG. 1.

FIG. 1-2 is a side view, in partial cross-section, of the bench vise of FIG. 1.

FIG. 1-3 is a rear view of the bench vise of FIG. 1.

FIG. 2 is a perspective view of another embodiment of the bench vise of the present invention.

FIG. 2-1 is a top plan view, in partial cross-section, of the bench vise of FIG. 2.

FIG. 2-2 is a side view, in partial cross-section, of the bench vise of FIG. 2.

FIG. 2-3 is a rear view of the bench vise of FIG. 2.

DESCRIPTION OF THE PREFERRED EMBODIMENTS

Figure 1:
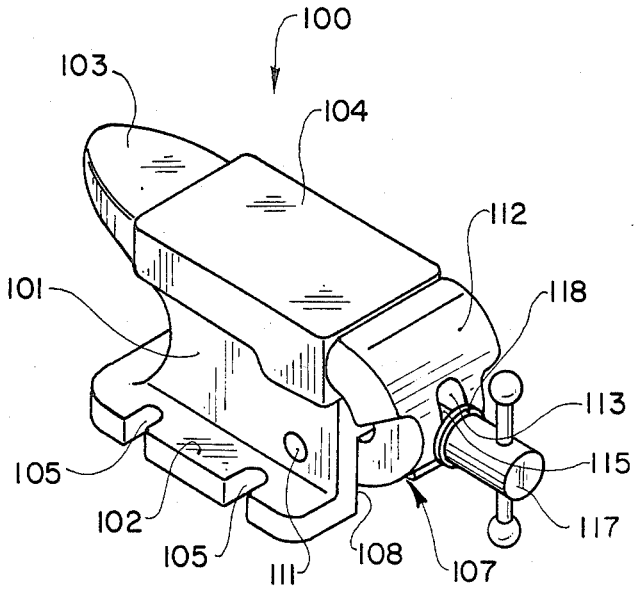
FIG. 1 is a perspective view of the bench vise of the present invention.
Figure 1:
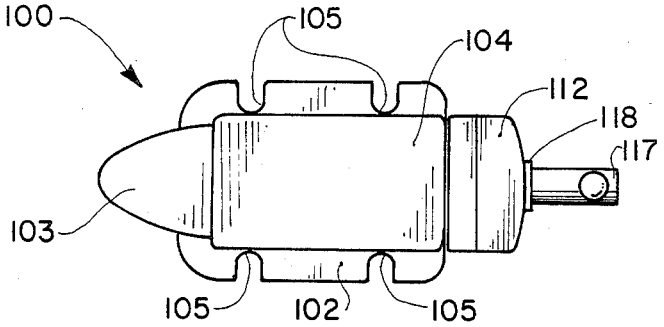
Figures 1, 2:
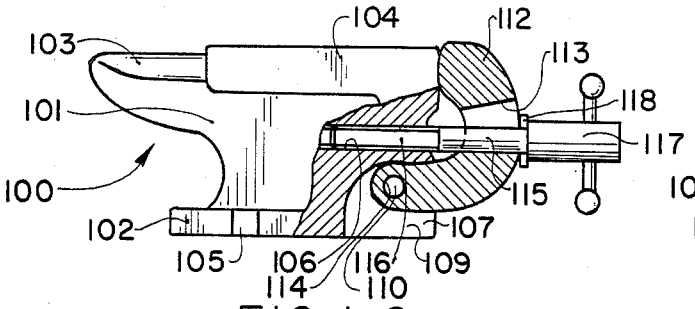
Figures 1, 2, 3:
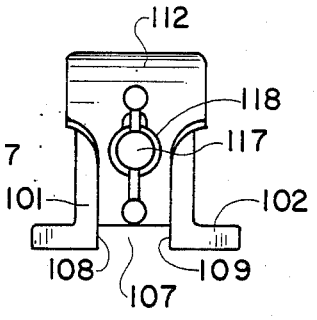
Figure 2:
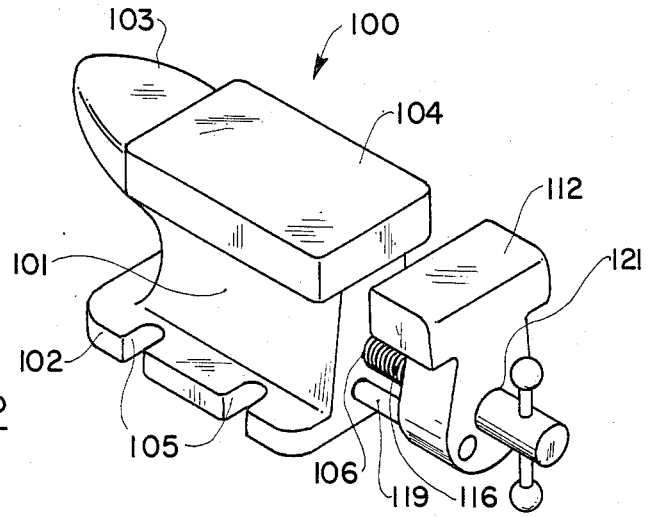
Figures 1, 2:
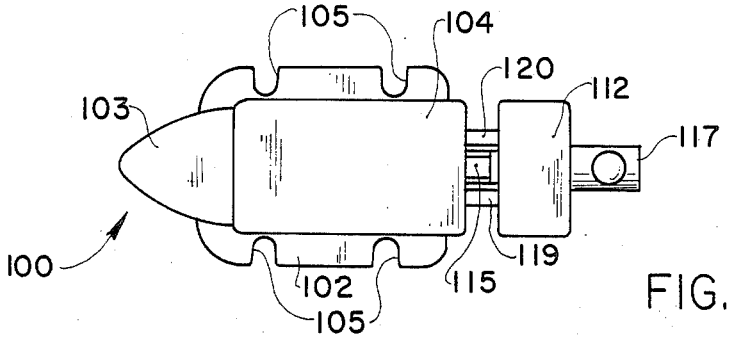
Figure 2:
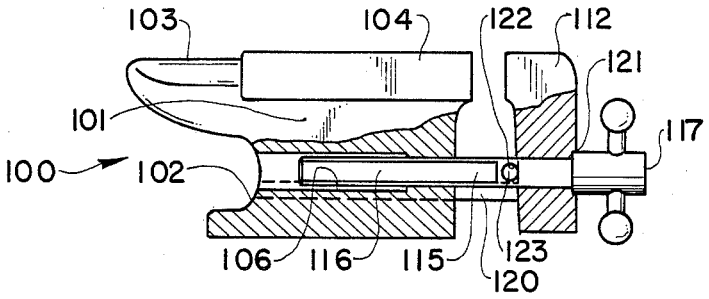
Figures 2, 3:
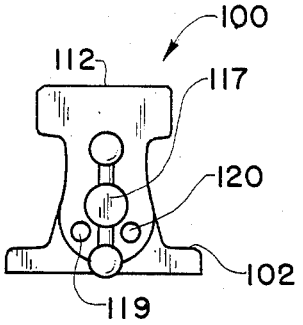

Referring now to the drawings, in FIGS. 1, 1-1, 1-2 and 1-3 there is illustrated the bench vise having the pivoting jaw. The vise 100 is provided with a main body portion 101 having a flat upper surface and an outwardly extending annular flanged base portion 102. Said flanged portion 102 is formed about the periphery of the base of said main body 101. Integrally formed on the forward portion of the main body is an anvil 103. Also integrally formed with the main body portion 101 is a flat, fixed jaw 104. Jaw 104 is located on the top of the main body extending rearwardly from the anvil 103 and terminating on the rearward portion of said main body 101. Said flat upper surface of jaw 104 is substantially coterminous with the upper surface of the main body, defining a substantially coterminous plane therewith.

The flanged base portion 102 is provided with a plurality of notches 105 formed about the periphery thereof. Bolts (not shown) are received in these notches for suitably securing the device to the surface of a bench, such as a table, ledge, etc.

The flat, fixed jaw is, preferably, substantially rectangular in shape. The fixed jaw includes a clamping surface which is also preferably substantially rectangular in shape.

The main body 101 is further formed with a threaded hole (tapped recess) 106. Hole 106 is positioned on a horizontal plane below the fixed jaw 104 and is formed extending longitudinally into the rearward portion of the main body 101. The main body 101 is also formed with a slot 107. Slot 107 extends longitudinally into the rearward portion of the main body 101. Slot 107 is located below the hole 106 and defines a pair of parallel body walls 108 and 109. Said walls 108 and 109 each have a pivot aperture 110 formed therein. Apertures 110 are aligned on a common longitudinal axis to receive a pivot rod 111 therethrough, as shall be discussed below.

Arcuate movable, jaw 112 is also provided. As shown, the curvature of said jaw is greater than 180°. Jaw 112 has a smooth clearance slot 113 formed therein. Slot 113 is elongated in shape (as shown, in cross-section, the slot is substantially frusto-conical in shape); and is positioned on a substantially vertical plane. The lower portion of the jaw 112 is formed having a pivot aperture 114. The pivot aperture 114 is aligned with pivot apertures 110 of the walls 108 and 109. Thus aligned, pivot rod 111 is received through apertures 114, and 110 respectively and suitably secured in place and thereby defining a pivot point. The pivot point is positioned thusly, being located forwardly of the clamping surface of the fixed jaw and above the top surface of the bench. Said pivot point is further seen being intermediate the forward end of the crank and the top surface of the bench. Positioned and secured thusly, the arcuate movable jaw 112, pivoting about the pivot point may be pivoted towards the fixed jaw 104 for clamping and, alternatively, may be pivoted away from the fixed jaw 104 for releasing. Slot 107 provides suitable clearance to allow the free pivotal movement of the movable jaw 112, therein.

Pivoting of the jaw for clamping and releasing workpieces is provided by a crank rod 115. Crank rod 115 has a forward threaded portion 116 and a rearward cranking handle 117. An annular collar 118 is formed forwardly of the cranking handle 117. The crank rod 115 is received through slot 113 and in hole 106, respectively. Positioned thusly, the rod 115 threadily engages the hole 106. Manual rotational movement of the cranking handle 117 rotates the rod 115 and, due to the threading engagement between the rod 115 and hole 106, the rod moves either towards or away from the fixed jaw 104, depending on the rotational movement of the crank handle 117. Forward movement of the rod 115 causes the collar 118 to contact the movable jaw 112, forcing it forwardly for clamping. Rearward movement of the rod 115 causes the collar 118 to move rearwardly, allowing the movable jaw 112 to fall away from the fixed jaw 104, said jaw 112 being retained only by the collar 118. Formed thusly, the clamping action of the jaws occurs below the coterminous plane. During such clamping action, the uppermost extremity of the movable jaw is substantially coterminous with the flat upper surface of the fixed jaw.

Referring now to FIGS. 2, 2-1, 2-2, and 2-3 there is illustrated the bench vise having a traditional jaw. The main body 101 of this embodiment is identical to that depicted in FIGS. 1, 1-1, 1-2 and 1-3 including the flanged base 102, the anvil 103, the fixed flat jaw 104, notches 105 and hole 106. However, as illustrated here, the slot 107 is omitted (and hence walls 108 and 109 and apertures 110 are also not provided). In its place a pair of guide rods 119 and 120 provided being piloted in the main body on a longitudinal axis being substantially parallel to the hole 106. Guide rods 119 and 120 are further positioned on an identical horizontal plane being positioned on either side of hole 106 and equidistant therefrom.

The movable jaw 112 is formed with a forwardly extending lip on the upper portion thereof for contacting the fixed jaw 104 during clamping. The rods 119 and 120 are received in the jaw 112, said jaw 112 being carried by the rods 119 and 120. Formed in the jaw 112 is a crank rod aperture 121 being positioned above the guide rods 119 and 120 equidistant therebetween.

Crank rod 115 has a forward threaded portion 116 and an enlarged rearward annular cranking handle 117 defining an annular shoulder between the handle 117 and the rest of the rod 115. Handle 117 is formed having a greater diameter than aperture 121. Crank rod 115 is further formed with a transverse aperture 122 therethrough. Crank rod 115 is received through aperture 121 and in hole 106, respectively. Positioned thusly, the rod 115 threadily engages the hole 106, and the shoulder abuts the aperture 121. A transverse pin 123 is disposed through aperture 122 to prevent further undesired movement of the rod 115. Manual rotational movement of the cranking handle 117 rotates the rod 115 due to the threading engagement between the rod 115 and hole 106. The rod either moves towards, or away from, the fixed jaw 104, depending on the rotational movement of the crank handle 117. Forward movement of the rod 115 causes the shoulder to contact the movable jaw 112, forcing it forwardly for clamping. Rearward movement of the rod 115 causes the shoulder to move rearwardly, allowing the movable jaw to move away from the fixed jaw 104 on the guide rods 119 and 120.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a bench vise for clamping a workpiece, said bench vise being supported on the top surface of a bench, said bench vise being of the type having a fixed jaw including a clamping surface, a main body and an arcuately-shaped movable jaw, said movable jaw being arcuately movable in a direction towards the fixed jaw for clamping the workpiece therebetween, wherein the improvement comprising the main body having a slot formed therein and the movable jaw being substantially arcuately formed, the curvature thereof exceeding 180°, said movable jaw being received in said slot, pivotably secured therein to the vise at a position located above the top surface of the bench and forwardly of the clamping surface of the fixed jaw.

2. A bench vise for clamping a workpiece, said bench vise being supported on the top surface of a bench, said bench vise comprising: a main body portion having a flat upper surface, a forward portion and a rearward portion; an anvil integrally formed on the forward portion of the main body; a flat, fixed jaw positioned rearwardly of the anvil; said fixed jaw having a clamping surface, and a flat upper surface being substantially coterminous with the flat upper surface of the main body, defining a substantially coterminous plane therewith; said main body portion having a longitudinally extending threaded aperture formed in the rearward portion, and further having a slot formed therein below the threaded aperture; an arcuately movable jaw being received in the slot, wherein said movable jaw is secured to the main body about a pivot point for pivotal movement thereabout, said pivot point being located forwardly of the clamping surface of the fixed jaw and above the top surface of the bench, said movable jaw being substantially arcuately formed, the curvature thereof exceeding 180°, said movable jaw further having an elongated slot formed therein; means for securing the movable jaw to the main body about the pivot point for pivotal movement of the movable jaw; a crank rod having a forward threaded end and a rearward crank handle, said rod being disposed through the elongated slot and the threaded aperture respectively, wherein the forward threaded end of the crank rod threadably engages the threaded aperture, such that rotational movement of the rearward crank handle results in concommittant rotation of that portion of the rod carrying the movable jaw thereon, pivoting said jaw towards the fixed jaw for clamping a workpiece therebetween below the coterminous plane, and further such that counter rotational movement of the rearward crank handle results in counter concommittant rotation of that portion of the rod carrying the movable jaw thereon, pivoting said jaw away from the fixed jaw for releasing a workpiece clamped therebetween.

3. A bench vise for clamping a workpiece, said bench vise being supported on the top surface of a bench, said vise being comprised of: a main body portion having a flat upper surface, a forward portion and a rearward portion, including a slot formed therein, said rearward portion further having a tapped recess formed therein above the slot; a flat, fixed jaw positioned on the rearward portion above the tapped recess, said fixed jaw having a clamping surface and a flat upper surface being substantially coterminous with the flat upper surface of the main body, defining a substantially coterminous plane therewith; an arcuately-shaped movable jaw having a curvature of greater than 180°, and further having an elongated slot formed therein, a pivot pin being carried by the movable jaw, wherein said pivot pin being disposed in the main body below the tapped recess forwardly of the clamping surface of the fixed jaw and above the top surface of the bench, said pivot pin being oriented on an axis transverse to the direction of movement of the movable jaw, whereby pivotal movement of the jaw is provided; a rod having a forward threaded end and a rearward end said rod being received through the elongated slot, the forward end thereof threadably engaging the tapped recess, and a handle means carried on the rearward end of the rod, wherein rotational movement of the handle means pivots the movable jaw in a direction towards the fixed jaw, thereby clamping a workpiece therebetween below the coterminous plane, and further, wherein counter rotational movement of the handle means pivots the movable jaw in a direction away from the fixed jaw, thereby releasing a workpiece clamped therebetween.

4. The bench vise of claim 2, wherein the means for securing the movable jaw to the main body about the pivot point for pivotal movement of the movable jaw secures said movable jaw such that, during clamping of the workpiece between the movable jaw and the fixed jaw, the uppermost extremity of the movable jaw is substantially coterminous with the flat upper surface of the fixed jaw.

5. The bench vise of claim 2, further comprising: the main body further having an outwardly extending annular flange formed about the periphery of the base of said main body, wherethrough said means is disposed for securing the vise to the surface of a bench.

6. The bench vise of claim 2, wherein the pivot point is positioned intermediate the forward end of the crank rod and the surface of the bench.

7. The bench vise of claim 2, wherein the elongated slot of the movable jaw, in cross-section, is substantially frusto-conical in shape.

8. A bench vise for clamping a workpiece, said bench vise being supported on the top surface of a bench, said bench vise comprising: a main body portion having a flat upper surface, a forward portion and a rearward portion; an anvil integrally formed on the forward portion of the main body; a flat, fixed jaw positioned rearwardly of the anvil; said fixed saw having a clamping surface, and a flat upper surface being substantially coterminous with the flat upper surface of the main body, defining a substantially coterminous plane therewith; said main body portion having a longitudinally extending threaded aperture formed in the rearward portion, and further having a slot formed therein below the threaded aperture; an arcuately movable jaw being received in the slot, wherein said movable jaw is secured to the main body about a pivot point for pivotal movement thereabout, said pivot point being located forwardly of the clamping surface of the fixed jaw and above the top surface of the bench, said movable jaw being substantially arcuately formed, the curvature thereof exceeding 180°, said movable jaw further having an elongated slot formed therein; means for securing the movable jaw to the main body about the pivot point for pivotal movement of the movable jaw; a crank rod having a forward threaded end and a rearward crank handle, said rod being disposed through the elongated slot and the threaded aperture respectively, wherein the forward threaded end of the crank rod threadably engages the threaded aperture, such that rotational movement of the rearward crank handle results in concommittant rotation of that portion of the rod carrying the movable jaw thereon, pivoting said jaw towards the fixed jaw for clamping a workpiece therebetween below the coterminous plane, and further such that counter rotational movement of the rearward crank handle results in counter concommittant rotation of that portion of the rod carrying the movable jaw thereon, pivoting said jaw away from the fixed jaw for releasing a workpiece clamped therebetween; wherein the means for securing the movable jaw to the main body about the pivot point for pivotal movement of the movable jaw secures said movable jaw such that, during clamping of the workpiece between the movable jaw and the fixed jaw, the uppermost extremity of the movable jaw is substantially coterminous with the flat upper surface of the fixed jaw; wherein the main body further having an outwardly extending annular flange formed about the periphery of the base of said main body, wherethrough said means is disposed for securing the vise to the surface of a bench, wherein the pivot point is positioned intermediate the forward end of the crank rod and the surface of the bench, wherein the elongated slot of the movable jaw, in cross-section, is substantially frusto-conical in shape.

9. The bench of claim 3, wherein during clamping of a workpiece between the movable jaw and the fixed jaw, the uppermost extremity of the movable jaw is substantially coterminous with the flat upper surface of the fixed jaw.

10. The bench of claim 3, further comprising: the main body further having an outwardly extending annular flange formed about the periphery of the base of said main body, wherethrough said means is disposed for securing the vise to the surface of a bench.

11. The bench of claim 3, wherein the pivot pin is positioned intermediate the forward end of the rod and the surface of the bench.

12. The bench of claim 3, wherein the elongated slot of the movable jaw, in cross-section, is substantially frusto-conical in shape.

13. A bench vise for clamping a workpiece, said bench vise being supported on the top surface of a bench, said vise being comprised of: a main body portion having a flat upper surface, a forward portion and a rearward portion, including a slot formed therein, said rearward portion further having a tapped recess formed therein above the slot; a flat, fixed jaw positioned on the rearward portion above the tapped recess, said fixed jaw having a clamping surface and a flat upper surface being substantially coterminous with the flat upper surface of the main body, defining a substantially coterminous plane therewith; an arcuately-shaped movable jaw having a curvature of greater than 180°, and further having an elongated slot formed therein; a pivot pin being carried by the movable jaw, wherein said pivot pin being disposed in the main body below the tapped recess forwardly of the clamping surface of the fixed jaw and above the top surface of the bench, said pivot pin being oriented on an axis transverse to the direction of movement of the movable jaw, whereby pivotal movement of the jaw is provided; a rod having a forward threaded end and a rearward end said rod being received through the elongated slot, the forward end therefor threadably engaging the tapped recess, and a handle means carried on the rearward end of the rod, wherein rotational movement of the handle means pivots the movable jaw in a direction towards the fixed jaw, thereby clamping a workpiece therebetween below the coterminous plane, and further, wherein counter rotational movement of the handle means pivots the movable jaw in a direction away from the fixed jaw, thereby releasing a workpiece clamped therebetween, wherein during clamping of a workpiece between the movable jaw and the fixed jaw, the uppermost extremity of the movable jaw is substantially coterminous with the flat upper surface of the fixed jaw; wherein the main body further having an outwardly extending annular flange formed about the periphery of the base of said main body, wherethrough said means is disposed for securing the vise to the surface of a bench, wherein the pivot pin is positioned intermediate the forward end of the rod and the surface of the bench, wherein the elongated slot of the movable jaw, in cross-section, is substantially frusto-conical in shape.

* * * * *